US007823349B2

(12) United States Patent
Alexander

(10) Patent No.: US 7,823,349 B2
(45) Date of Patent: Nov. 2, 2010

(54) MASONRY WALL VENT

(76) Inventor: Ernest E. Alexander, 36 Woodview Dr., Pittsboro, IN (US) 46167

( * ) Notice: Subject to any disclaimer, the term of this patent is extended or adjusted under 35 U.S.C. 154(b) by 0 days.

(21) Appl. No.: 12/539,236

(22) Filed: Aug. 11, 2009

(65) Prior Publication Data

US 2009/0293394 A1 Dec. 3, 2009

Related U.S. Application Data

(62) Division of application No. 11/135,944, filed on May 24, 2005, now abandoned.

(60) Provisional application No. 60/574,454, filed on May 26, 2004.

(51) Int. Cl.
*E04B 1/70* (2006.01)

(52) U.S. Cl. ..... 52/302.1; 52/220.1

(58) Field of Classification Search ..... 52/61, 52/62, 97, 384, 302.1, 302.4, 302.3, 220.1, 52/220.8, 220.2, 220.3, 503, 505, 504; 160/44
See application file for complete search history.

(56) References Cited

U.S. PATENT DOCUMENTS

| | | | |
|---|---|---|---|
| 948,007 | A | 2/1910 | Doane |
| 2,197,874 | A | 4/1940 | Myers |
| 2,285,026 | A | 6/1942 | Fulcher |
| 2,645,824 | A | 7/1953 | Titsworth |
| 2,657,570 | A | 11/1953 | Moore |
| 2,934,931 | A | 5/1960 | Johnson et al. |
| 3,257,929 | A | 6/1966 | Kortvely |
| 3,283,460 | A | 11/1966 | Patrick |
| 3,429,084 | A | 2/1969 | Brewer |
| 3,668,829 | A | 6/1972 | Nelson |
| 3,852,925 | A | 12/1974 | Gazzo |
| 3,999,349 | A | 12/1976 | Miele et al. |
| 4,102,093 | A | 7/1978 | Harris |
| 4,106,475 | A | 8/1978 | Mayes |
| 4,248,206 | A | 2/1981 | Orthey, Jr. |
| 4,253,285 | A | 3/1981 | Enright |
| 4,282,691 | A | 8/1981 | Risdon |
| 4,333,281 | A | 6/1982 | Scarfone |
| 4,381,630 | A | 5/1983 | Koester |
| 4,574,772 | A | 3/1986 | Nagel |
| 4,612,742 | A | 9/1986 | Bevilacqua |
| 4,723,533 | A | 2/1988 | Cover |
| 4,819,613 | A | 4/1989 | McDonald et al. |
| 4,852,320 | A | 8/1989 | Ballantyne |
| 4,907,385 | A | 3/1990 | Biodrowski |
| 5,274,968 | A | 1/1994 | Pardo |
| 5,343,661 | A | 9/1994 | Sourlis |
| D372,068 | S | 7/1996 | Disanto |
| 5,598,673 | A | 2/1997 | Atkins |
| 5,768,842 | A | 6/1998 | Austin |

(Continued)

*Primary Examiner*—Richard E Chilcot, Jr.
*Assistant Examiner*—Jessica Laux
(74) *Attorney, Agent, or Firm*—Woodard Emhardt Moriarty McNett & Henry LLP

(57) ABSTRACT

A vent for an exterior brick wall. The vent includes a first enclosure which is installed in the brick wall in place of an entire brick. The enclosure defines a flow path from ambient conditions to the air in between the brick wall and an interior wall. The vent includes a shield for protecting the flow path of the enclosure from being obstructed by falling debris. Some embodiments includes a vertical section of vents which is also protected from falling debris such as trash mortar.

4 Claims, 12 Drawing Sheets

U.S. PATENT DOCUMENTS 5,771,643 A 6/1998 Parker
5,794,388 A 8/1998 Jackman
5,845,455 A 12/1998 Johnson, III
5,860,259 A 1/1999 Laska
5,870,864 A 2/1999 Snyder et al.
6,044,594 A 4/2000 Desselle
6,088,984 A 7/2000 Kirby
6,105,323 A 8/2000 Paulle
6,112,476 A * 9/2000 Schulenburg ..... 52/169.5
6,176,048 B1 1/2001 Berger
6,178,710 B1 1/2001 Colalillo
6,202,366 B1 3/2001 Snyder et al.
6,256,955 B1 7/2001 Lolley et al.
6,410,118 B1 6/2002 Reicherts et al.
6,474,031 B2 * 11/2002 Phillips ..... 52/302.1
6,662,504 B2 12/2003 Krogstad
6,684,579 B2 2/2004 Brunson et al.
2001/0023564 A1 9/2001 Phillips
2002/0139068 A1 10/2002 Janesky
2002/0152693 A1 * 10/2002 Krogstad ..... 52/58
2003/0046888 A1 3/2003 Ryan
2003/0084638 A1 5/2003 Vacek
2003/0115814 A1 6/2003 Nielsen
2003/0205129 A1 11/2003 Kretsinger et al.
2004/0000114 A1 1/2004 Schools et al.
2004/0003558 A1 1/2004 Collins et al.
2004/0058638 A1 * 3/2004 Achen ..... 454/277
2004/0123540 A1 7/2004 Regina

* cited by examiner

MASONRY WALL VENT

REFERENCE TO RELATED APPLICATIONS

This application is a divisional of U.S. patent application Ser. No. 11/135,944, filed May 24, 2005 now abandoned, which claims the benefit of U.S. Provisional Application No. 60/574,454, filed May 26, 2004, which is hereby incorporated by reference.

FIELD OF THE INVENTION

The invention relates to methods and apparatus for providing a vent through a wall, and in particular, a vent that replaces a exterior brick in a brick wall.

BACKGROUND OF THE INVENTION

Masonry cavity walls have inner and outer vertical walls. The inner wall is typically constructed from wood with an inner surface of drywall, structural clay tile, vertical stacks of mortared bricks, or a shear concrete surface. The outer wall is generally constructed from courses of bricks that are held together by mortar. A space, or cavity, exists between the two walls.

The porous nature of brick allows water to enter the cavity. Also, moisture can condense on the inside of the wall under changing temperatures. Either way, water may collect in the cavity between the inner and outer wall.

The presence of moisture in the space between the inner wall and outer wall is undesirable for a number of reasons. First, the trapped moisture can degrade the inner and outer wall, causing a weakening of the structure. Second, the presence of water under freezing temperatures may also cause cracks in the walls when the water expands as it freezes. Trapped water in the cavity between the inner and outer walls may cause the walls to become discolored, and may even leak into the dwelling. Yet another undesirable outcome from the presence of trapped water is the formation of mold on the interior wall which can render the structure uninhabitable.

To overcome the problems associated with water trapped within a masonry cavity wall, weep holes are sometimes placed along the base of the outer wall. The weep holes allow water to pass from the cavity to drain outside the wall structure. During construction of a masonry cavity wall, excess mortar and other debris can and does fall between the inner and outer wall. When the bricks are laid during the erection of the outer wall, for example, mortar droppings are squeezed into the space between the walls. The excess mortar, as well as other debris, drops to the base of the cavity, and can block the weep holes.

There are other solutions which attempt to overcome these problems. For example, some builders place a small breathable structure in the weep hole, or alternatively a small shield in the weep hole, either of which attempts to prevent mortar and other debris from obstructing passage of air through the hole. However, even if successful in preventing obstruction of the weep hole, these small between-brick weep holes often do not have flow paths which are sufficiently large enough to aerate and dry out interior walls that are damp enough to support mold growth or other damage caused by excessive moisture.

The present invention presents novel and non-obvious methods and apparatus for venting a brick wall.

SUMMARY OF INVENTION

According to one embodiment of the present invention, there is an apparatus for venting behind a brick wall. The apparatus includes a horizontal portion having substantially the same width and height as another brick in the wall. The horizontal vent includes at least one porous barrier. The horizontal vent includes an entrance and an exit. Preferably, the apparatus includes a shield for preventing falling debris from obstructing the vent.

Yet other embodiments of the present invention include a second vertical vent in fluid communication with the horizontal vent and extending in a direction substantially parallel to the height of the horizontal vent. The vertical vent can include a lateral face having at least one vent hole in fluid communication with the interior of the horizontal vent.

These and other aspects of various embodiments of the invention will be apparent from the drawings, description and claims to follow.

DESCRIPTION OF THE PREFERRED EMBODIMENT

Figure 1:
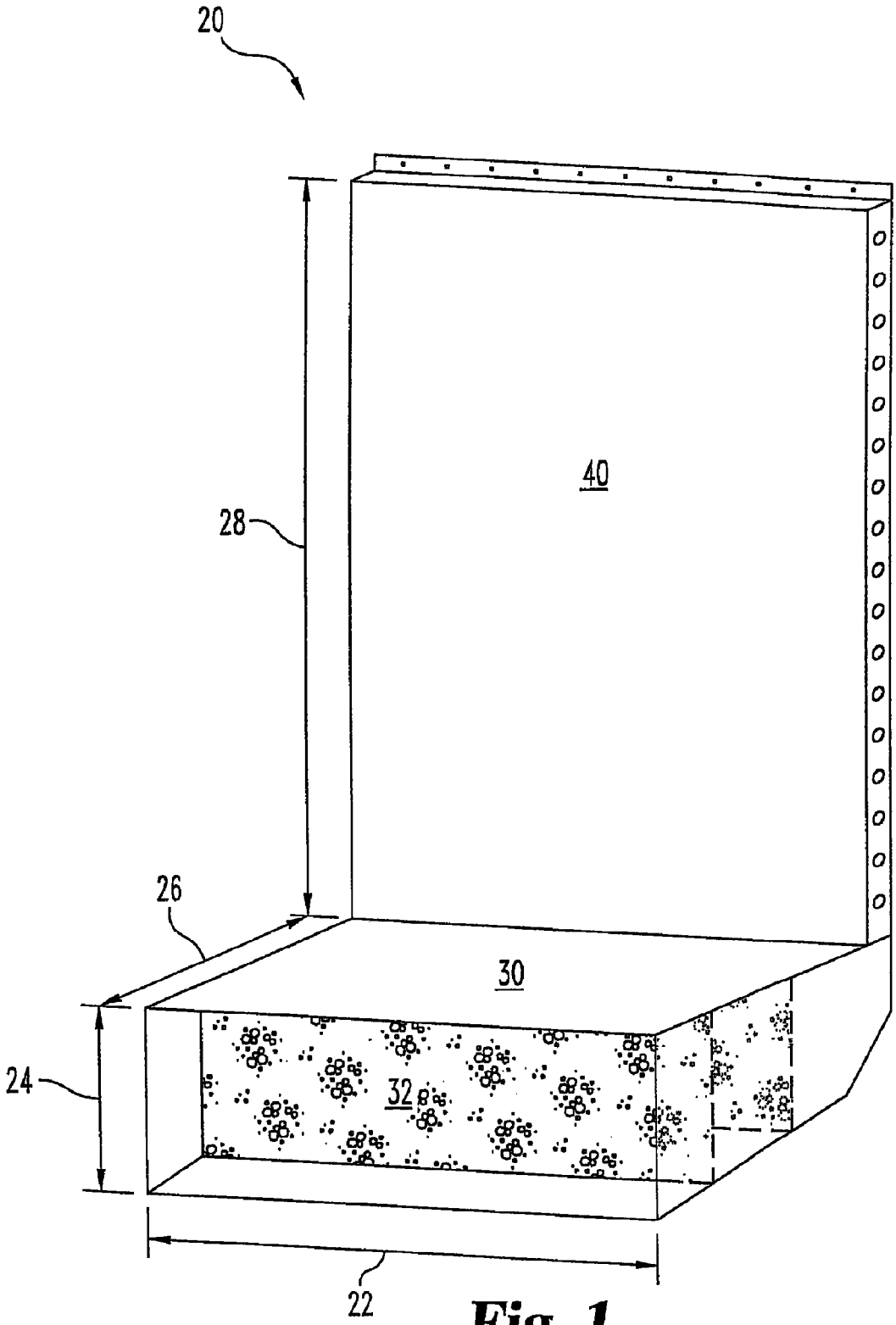
FIG. 1 is a front, side, and top perspective view of a vent assembly according to one embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The present invention relates to methods and apparatus for providing one or more vents through a wall of the building. In one embodiment, these vents are placed in a brick wall, although other embodiments of the invention are not so limited. In other embodiments, the present invention contemplates one or more vents through a wall at a first, low height, and one or more additional vents placed at a second, higher height in the wall.

In some embodiments, the present invention provides a venting assembly having a horizontal portion which replaces one brick from the wall. Preferably, when the wall is constructed, one brick is left out and the venting assembly is provided in its place. Preferably, the venting assembly is adhered to the surrounding bricks by mortar, although other embodiments of the present invention are not so limited.

In the preferred embodiment, the vent assembly has a horizontal portion which is adapted and configured to replace a brick. The dimensions for the length, height, and width of the horizontal portion are selected to be consistent with the size of the brick being replaced and consistent with the orientation of other bricks that are adjacent to the replaced brick.

Figure 3:
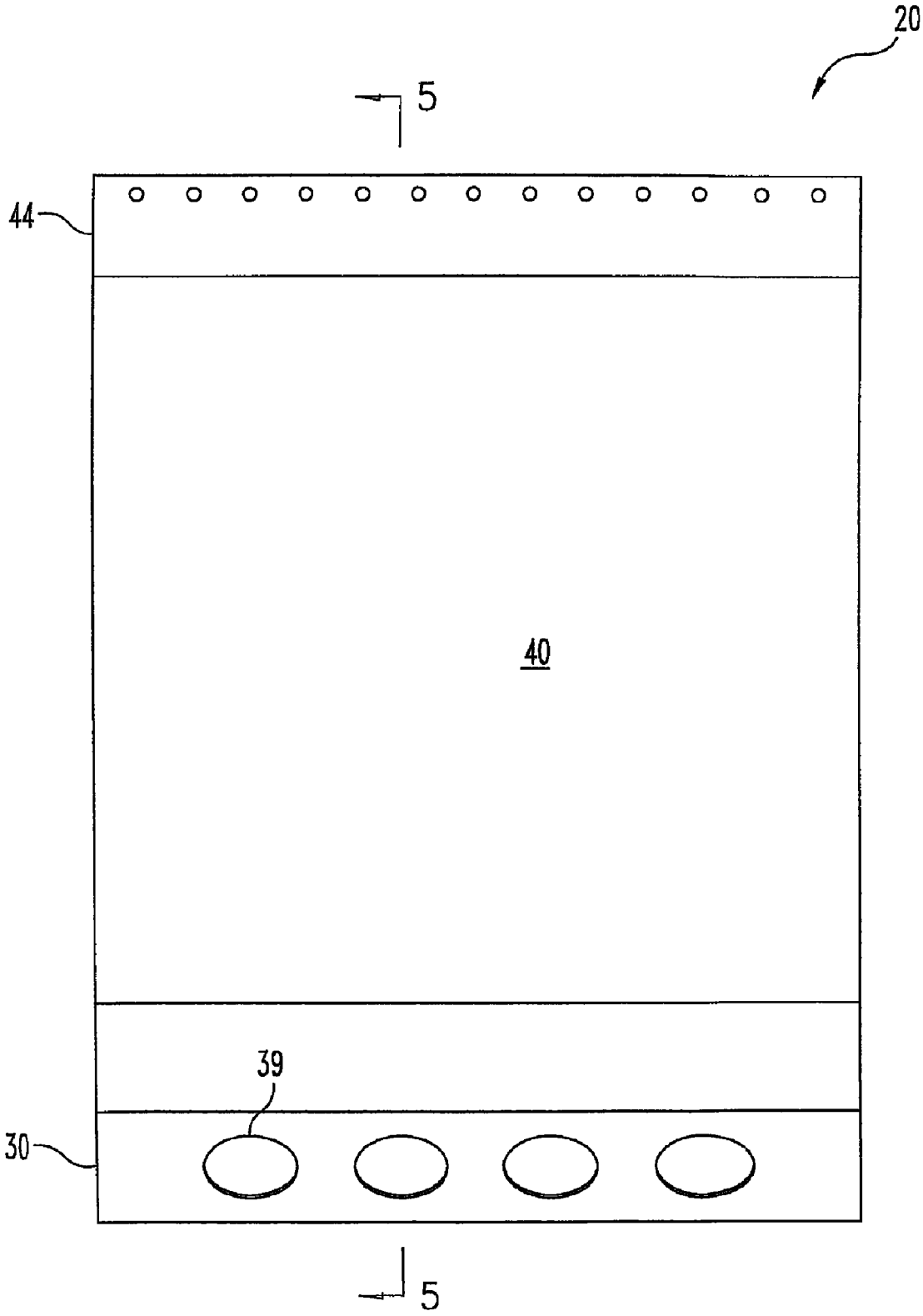
FIG. 3 is a rear view of the apparatus of FIG. 1.

Some bricks are identified by three dimensions: width, height and length. Height and length are sometimes called face dimensions for these are the dimensions showing when the brick is laid as a stretcher. The terms applied to brick positions as they are placed in a wall are shown in FIG. 3 at the web page www.bia.org/bia/technotes/t10B.htm of the Brick Industry Association. These positions include: soldier, sailor, stretcher, header, rowlock stretcher, and rowlock.

Bricks can be referred to in terms of nominal, specified and actual dimensions. Nominal dimensions are most often used by the architect in modular construction. In modular construction, dimensions of the brick and other building elements are often multiples of a given module. Such dimensions are known as nominal dimensions. For brick masonry the nominal dimension is equal to the specified unit dimension plus the intended mortar joint thickness. The intended mortar joint thickness is the thickness required so that the unit plus joint thickness match the coursing module. In the inch-pound system of measurement, nominal brick dimensions are based on multiples (or fractions) of 4 in. In the SI (metric) system, nominal brick dimensions are based on multiples of 100 mm. For more information on modular construction see Technical Notes 10A Revised.

As the name implies, the specified dimension is the anticipated manufactured dimension. Specified dimensions are used by the structural engineer in the rational design of brick masonry. In non-modular construction, the specified dimension should be used. Tables 1 and 2 of the aforementioned web site provide the specified and nominal dimensions, where applicable. The actual dimension of a unit is the dimension as manufactured. Actual dimensions may vary slightly from a specified size. The actual dimensions of a brick must fall within the range of sizes defined by the specified dimensions plus or minus the specified dimensional tolerances. Dimensional tolerances are often found in the ASTM standard specifications for brick, such as ASTM C 216 Standard Specification for Facing Brick. The various embodiments of the present invention shown and described herein can be used with any size, shape, and orientation of brick. The present invention contemplates those embodiments which can be used with any type of brick, regardless of whether the brick uses nominal, specified, or actual dimensions.

FIG. 1 shows a perspective view of a venting assembly 20 according to one embodiment of the present invention. Assembly 20 includes a horizontal vent 30 and a vertical vent 40. Horizontal vent 30 is adapted and configured to a length 22, front height 24, and depth 26 which are consistent with the size, shape, and orientation of the brick being replaced. As shown, vent assembly 20 includes a horizontal portion 30 having a nominal length of 8 inches, a nominal height of 2⅔ inches, and nominal depth of 4 inches. This brick size is sometimes referred to as a "modular" brick. The corresponding specified dimensions of this same brick are a length of 7⅝ inches, a height of 2¼ inches, and a depth of 3⅝ inches. However, the present invention also contemplates replacing bricks of other standard sizes, including the engineer modular, closure modular, roman, norman, engineer norman, utility, meridian, through-wall meridian, double meridian, double through-wall meridian, standard, engineer standard, closure standard, king, and queen.

In this particular embodiment, vent assembly 20 replaces one particular standard size of brick in the orientation shown in FIG. 1 (i.e., length 22 is the largest dimension of the replaced brick; height 24 is the smallest dimension of the replaced brick). However, the present invention contemplates wall vent assemblies adapted and configured to replace bricks which would otherwise have been placed on a front or rear surface, or on a left or right surface. For example, the present invention contemplates brick positions known as the soldier, sailor, stretcher, header, rowlock and rowlock stretcher. Further, in yet other embodiments of the present invention, the dimensions of the horizontal vent 30 are consistent with a half brick (such as a length that is one-half of the length 22 shown in FIG. 1). Further, the present invention contemplates wall vent assemblies that replace any standard size and standard shape of brick, including non-rectangular bricks and further including standard size and standard shape of concrete blocks and one-half size concrete blocks.

Figure 2:
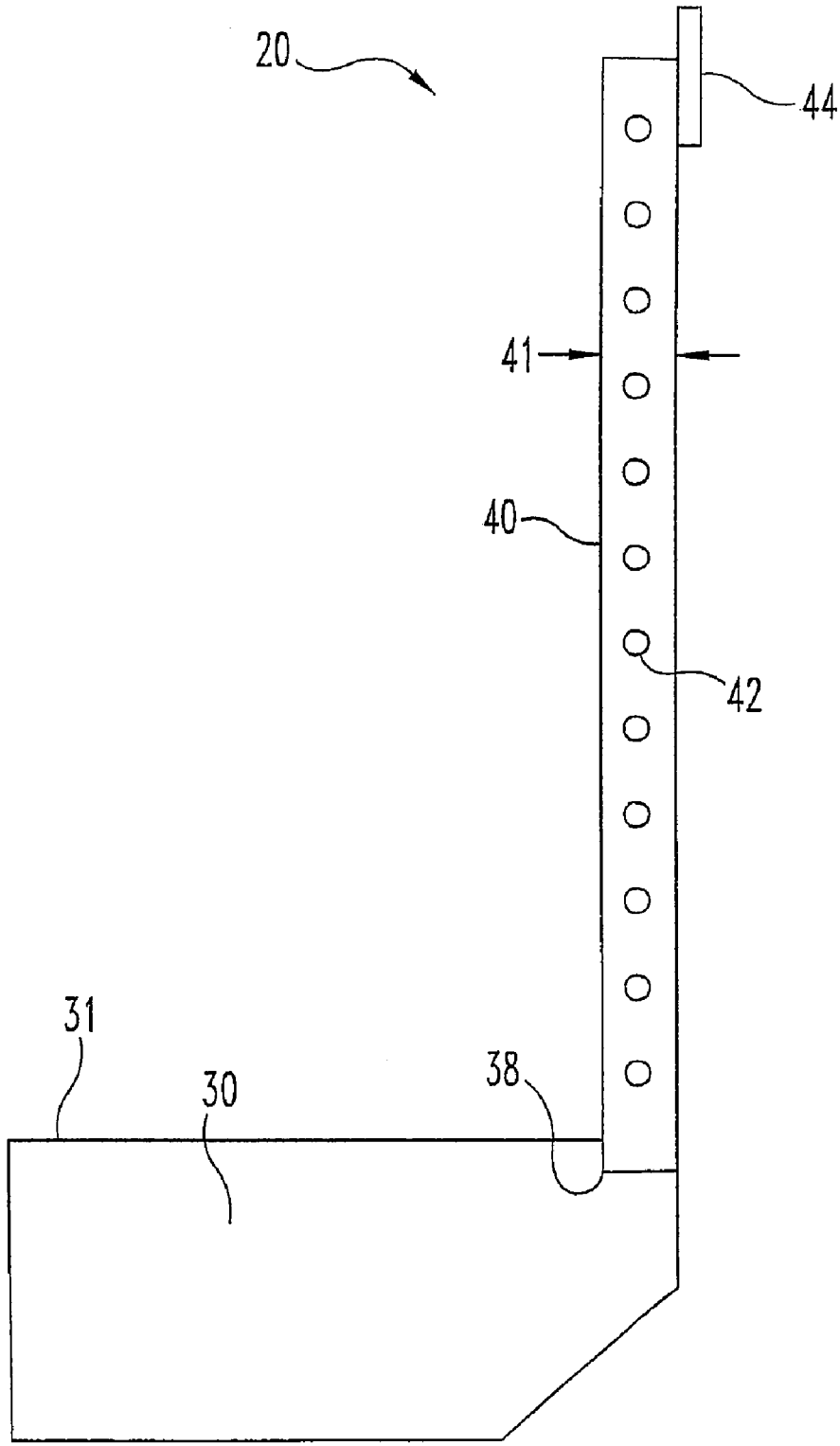
FIG. 2 is a side view of the apparatus of FIG. 1.
Figure 4:
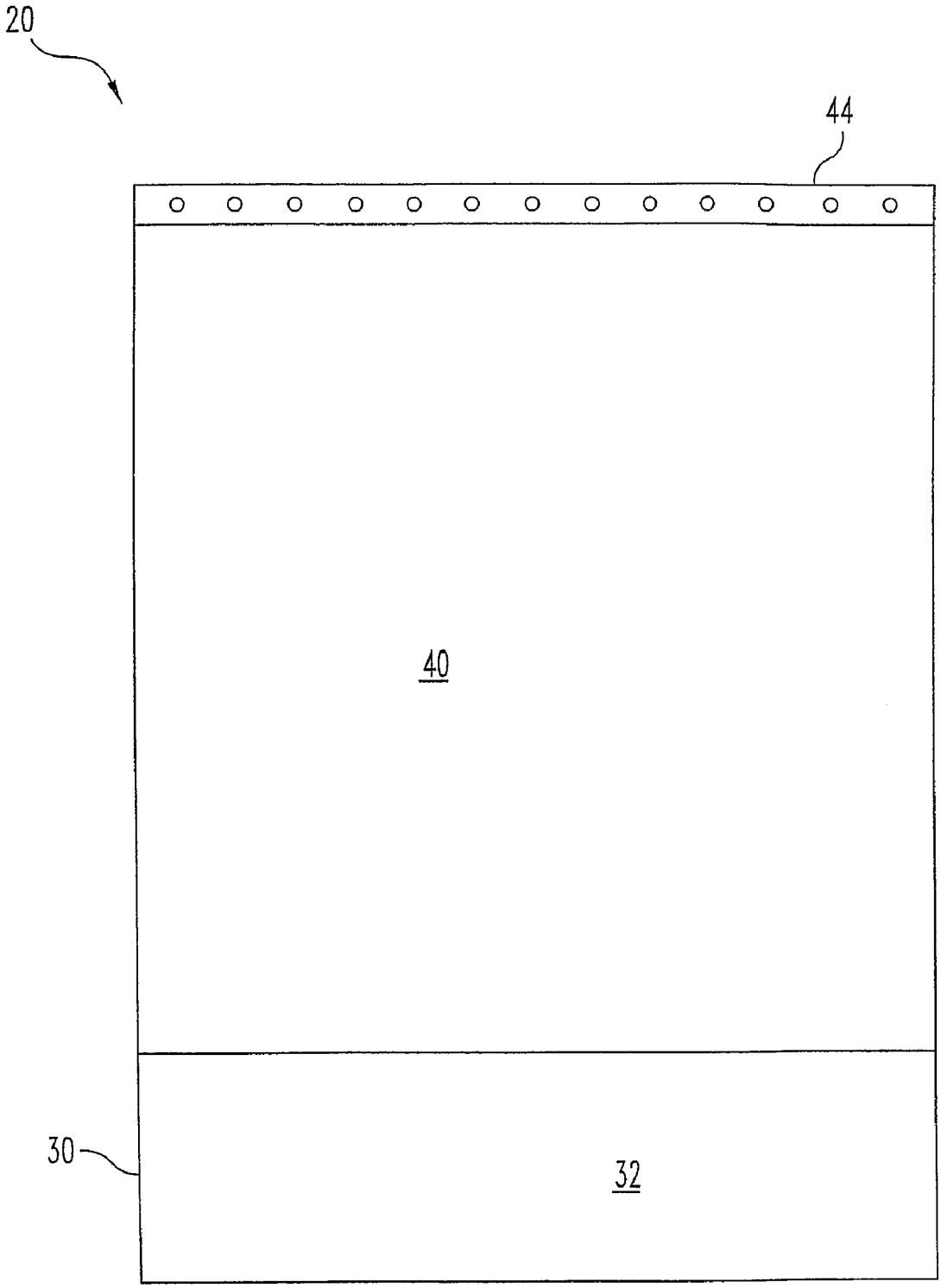
FIG. 4 is a front view of the apparatus of FIG. 1.

FIGS. 2, 3, and 4 show side, rear, and front views, respectively, of venting assembly 20. As best seen in FIG. 2, vent assembly 20 has a general L-shaped configuration. Horizontal vent 30 preferably includes a top surface 31 which has a depth greater than the depth of the brick to be placed above vent assembly 20, so that vertical vent 40 does not enter interfere with the back side of the brick placed above surface 31. Horizontal portion 30, in some embodiments, includes a rear slot 38 which is adapted and configured to couple to vertical vent 40. In other embodiments, the horizontal and vertical vents are formed integrally, including for example vent assemblies formed from sheet metal and also vent assemblies molded in plastic. However, the present invention is not limited to any particular type of fabrication, nor is there any limitation with regard to the coupling of the horizontal vent to the vertical vent.

Vertical vent 40 has a width that is preferably about the same as width 22, although the invention is not so limited. The height 28 of vent 40 preferably extends several inches above top surface 30, and more preferably extends upward a multiple of the height dimension 24 of a single brick. The depth of the vertical vent 40 is preferably less than the distance from the rear face of the adjacent bricks to the opposing face of the interior wall. In one embodiment, vertical vent 40 fits easily in the gap between the interior wall and the brick wall.

Figure 5:
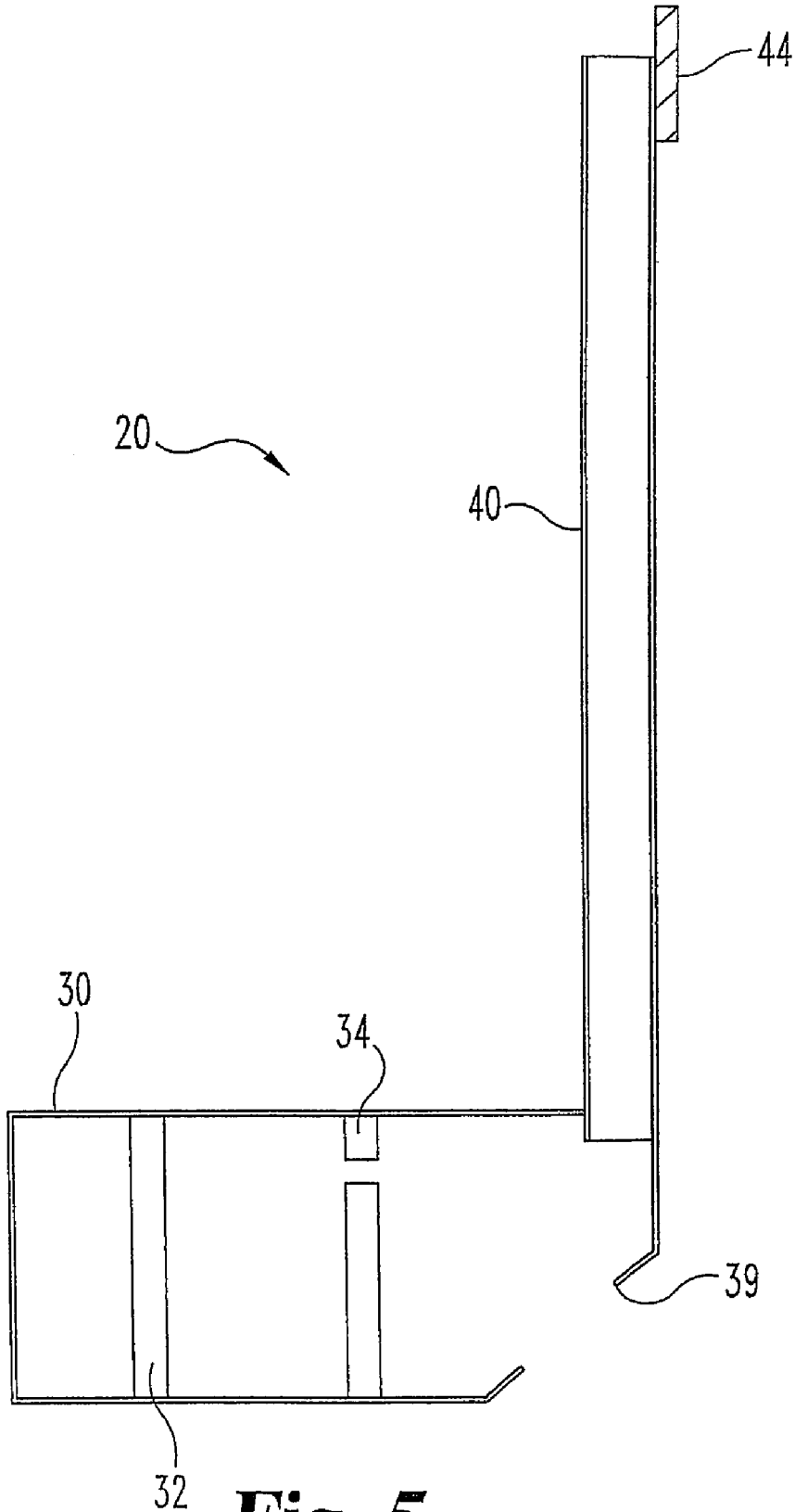
FIG. 5 is a cross sectional view of the apparatus of FIG. 3 as taken along line 5-5.

As best seen in FIG. 5, horizontal vent 30 includes a first porous barrier 32, a second porous barrier 34, and one or more rear vents 39. Preferably, first barrier 32 is adapted and configured to discourage insects and rodents from entering vent assembly 20. Preferably, second barrier 34 includes vent holes only in the upper half, such that a substantially solid bottom half acts as a barrier to prevent water from entering behind the wall from the outside. Further, one or more rear vents 39 minimize the volume of horizontal vent 30 which will hold water from the inside of the vented brick wall. Horizontal vent 30 permits the free flow of air and water vapor, especially from the inside of the vented wall outward to ambient conditions.

Horizontal vent 30 is in fluid communication with vertical vent 40. Vertical vent 40 extends upward inside the vented brick wall, preferably between the interior surface of the brick wall and the opposing surface of an inner wall (such as those fabricated from wood, a second row of brick, sheet rock, concrete blocks, or other suitable building materials). Preferably, vertical vent 40 is of a height that extends upward one or more rows of bricks. However, in other embodiments of the present invention, horizontal vent 40 has a more limited vertical height. In yet other embodiments, the vent assembly includes only a horizontal vent, with no vertical vent.

In a preferred embodiment, vertical vent 40 includes a plurality of side vents 42 which are in fluid communication with a largely open, unobstructed interior of horizontal vent 30. Preferably, vertical vent 40 does not include any vent holes along the top surface, which holes could otherwise be blocked by excess mortar as the brick wall is constructed. In some embodiments, vertical vent 40 includes a nail strip 44 for attaching vent assembly 20 to an interior wall with one or more fasteners.

Vent assembly 20 is preferably placed in a brick wall as the wall is being constructed. Horizontal vent 30 replaces one brick in its entirety. Vertical vent 40 extends upward behind the brick wall. Any water vapor or other gases between the brick wall and the second interior wall are free to enter vertical vent 40 through a side vent 42, flow into horizontal vent 30 through the connection at slot 38, and flow through porous barriers 32 and 34 out to ambient conditions.

Figure 6:
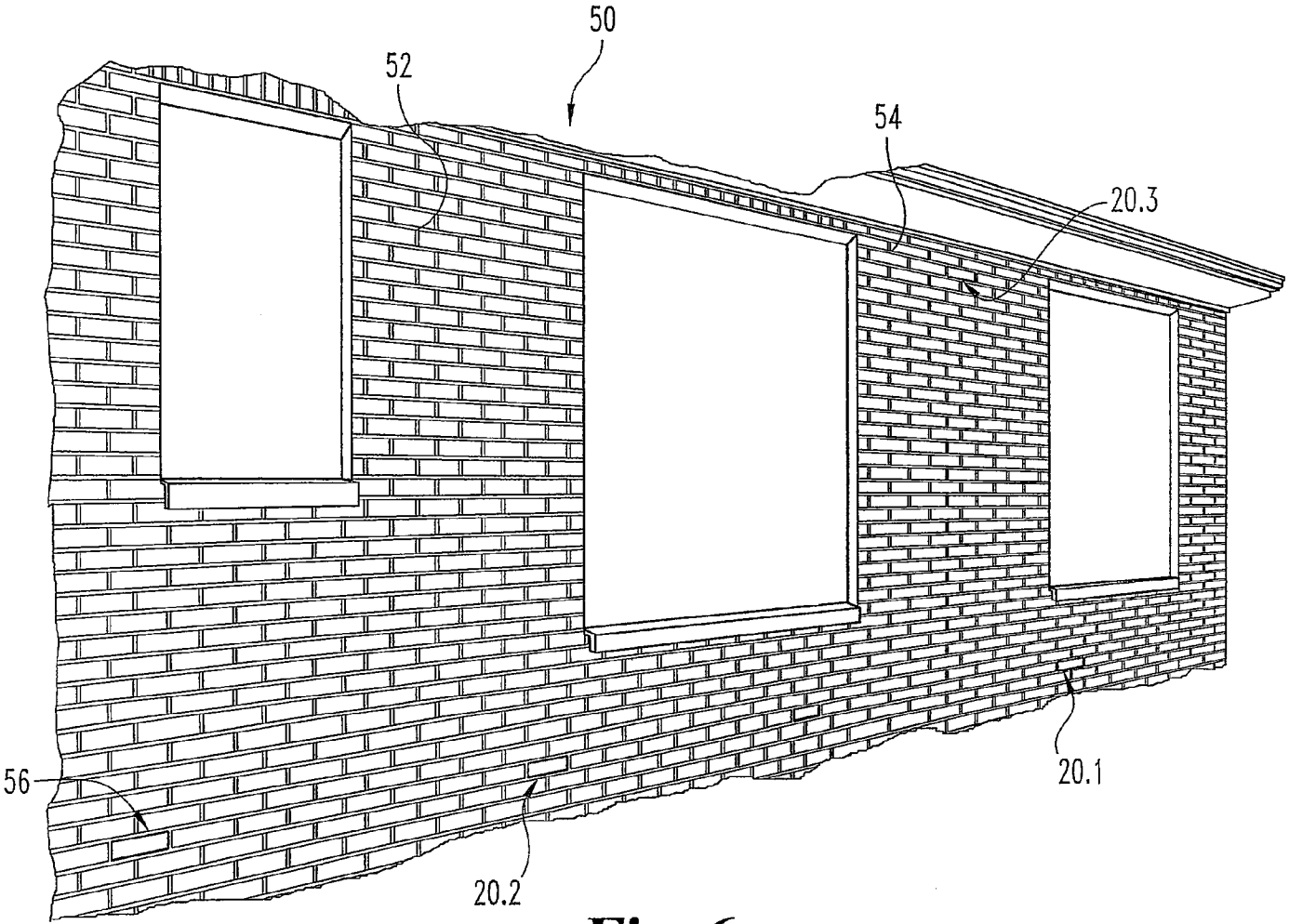
FIG. 6 is a perspective view of a brick wall of a building incorporating vent assemblies according to one embodiment of the present invention.
Figure 7:
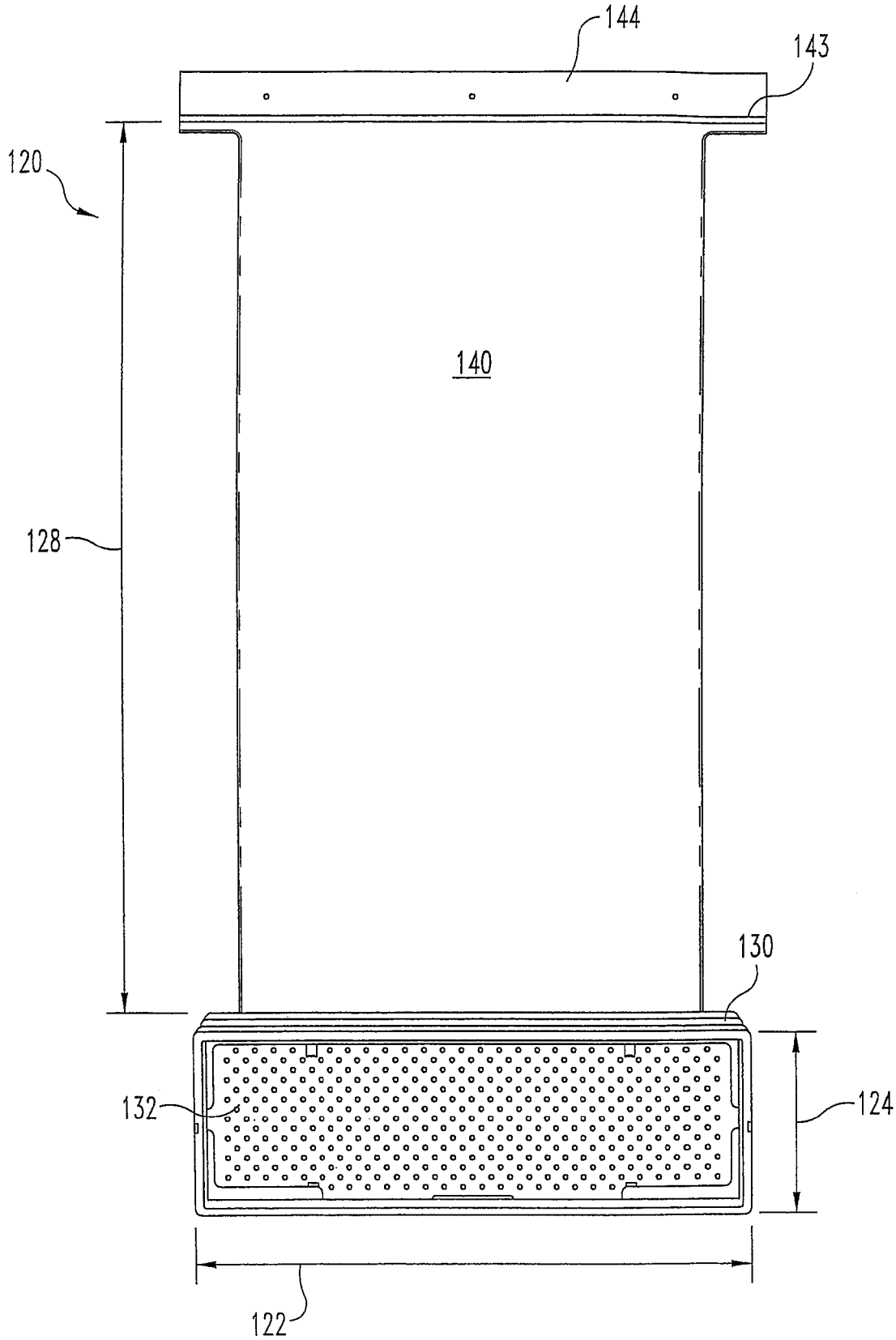
FIG. 7 is a front view of a vent assembly according to one embodiment of the present invention.

FIG. 6 shows a building 50 having an exterior wall 52 made from a plurality of bricks 54. As wall 52 is constructed, a plurality of brick-sized apertures are provided at a first height along the wall and relatively close to the ground. One or more additional brick-sized apertures 56 are also provided, in some embodiments of the present invention, at a second, greater height above the ground and closer to the building roof. As shown in FIG. 6, a plurality of vent assemblies 20.1 and 20.2 have been mortared into brick wall 52 within corresponding brick-sized apertures. A third, higher vent assembly 20.3 has been mortared into wall 52 at a second location near the top of wall 52.

FIGS. 7-12 depict yet another embodiment of the present invention. The use of a one-hundred prefix (1XX) in front of an element number (XX) refers to an element (1XX) that is the same as the element (XX), except for those changes shown and described. FIGS. 7-12 are drawn approximately to scale. However, the invention is not so constrained, and other scaling proportions are contemplated within other embodiments of the present invention.

FIGS. 7-10 depict various views of a wall vent assembly 120 according to another embodiment of the present invention. Vent assembly 120 preferably includes a horizontal vent or first enclosure 130 which is slidingly coupled to a shielding member 140. First enclosure 130 has a length 122, height 124, and width or depth 126 which are adapted and configured to replace a brick in a brick wall. Preferably, these dimensions are chosen such that enclosure 130 can be mortared into place in a brick wall in place of a commercially available brick. However, the present invention is not so constrained, and can also be sized to fit in a wall of custom shaped and sized bricks. In one embodiment, the length of the first enclosure is about 7.7 inches; the height is about 2.5 inches; and the width is about 3 inches. By adapting and configuring the dimensions of enclosure 130 to replace an entire brick, it is easy for an inspector to visually assure that the vent assembly has been installed, in contrast to small weep holes or weep insert product. Further, the much larger size of an entire brick as compared to the size of mortar in between bricks (as for a weep hole) further assures that the wall has an adequately sized flow path for breathing or natural convection into and out of the space in between the interior wall and the exterior brick wall.

Figure 9:
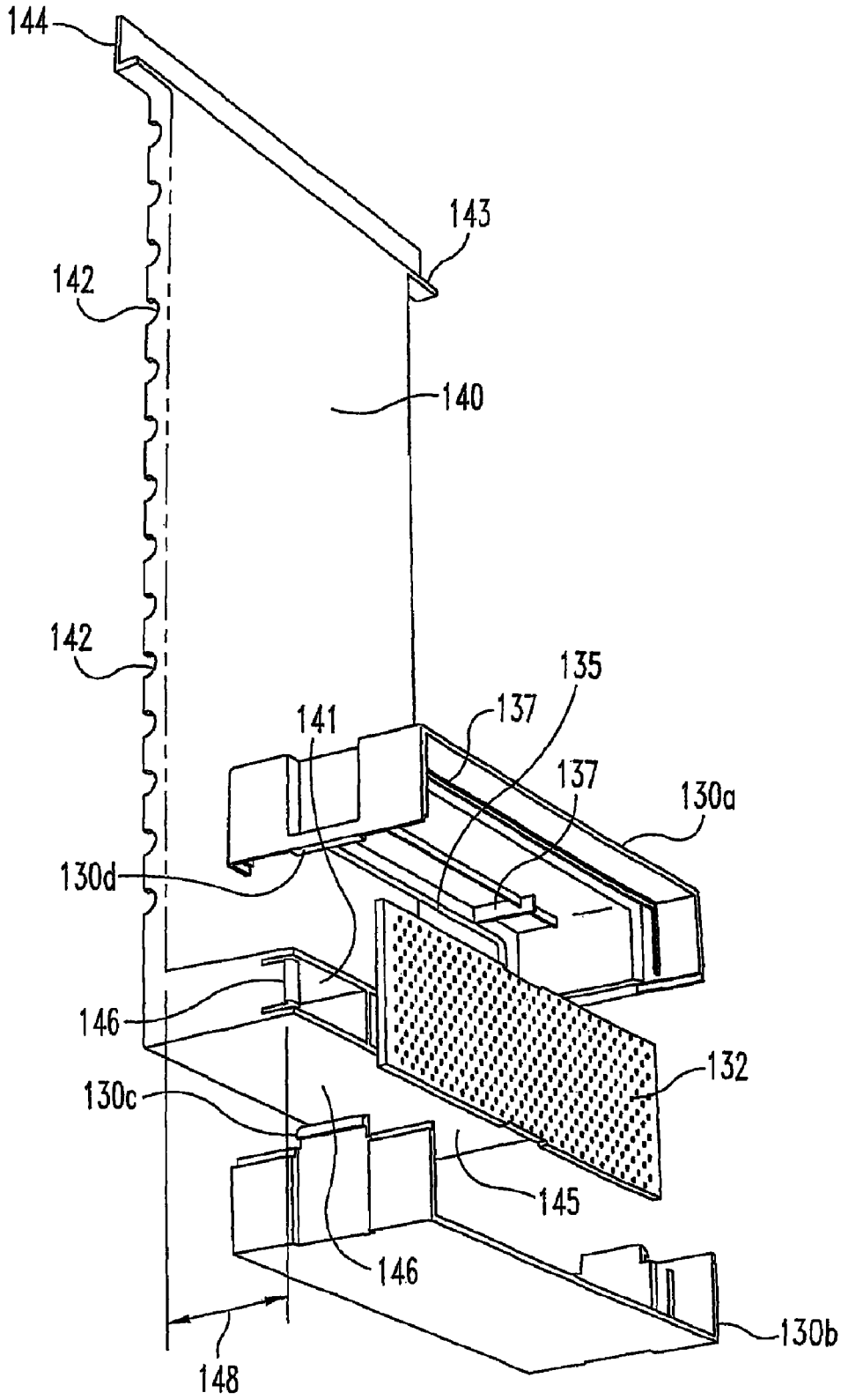
FIG. 9 is a front, bottom, left side exploded perspective view of the apparatus of FIG. 7.
Figure 10:
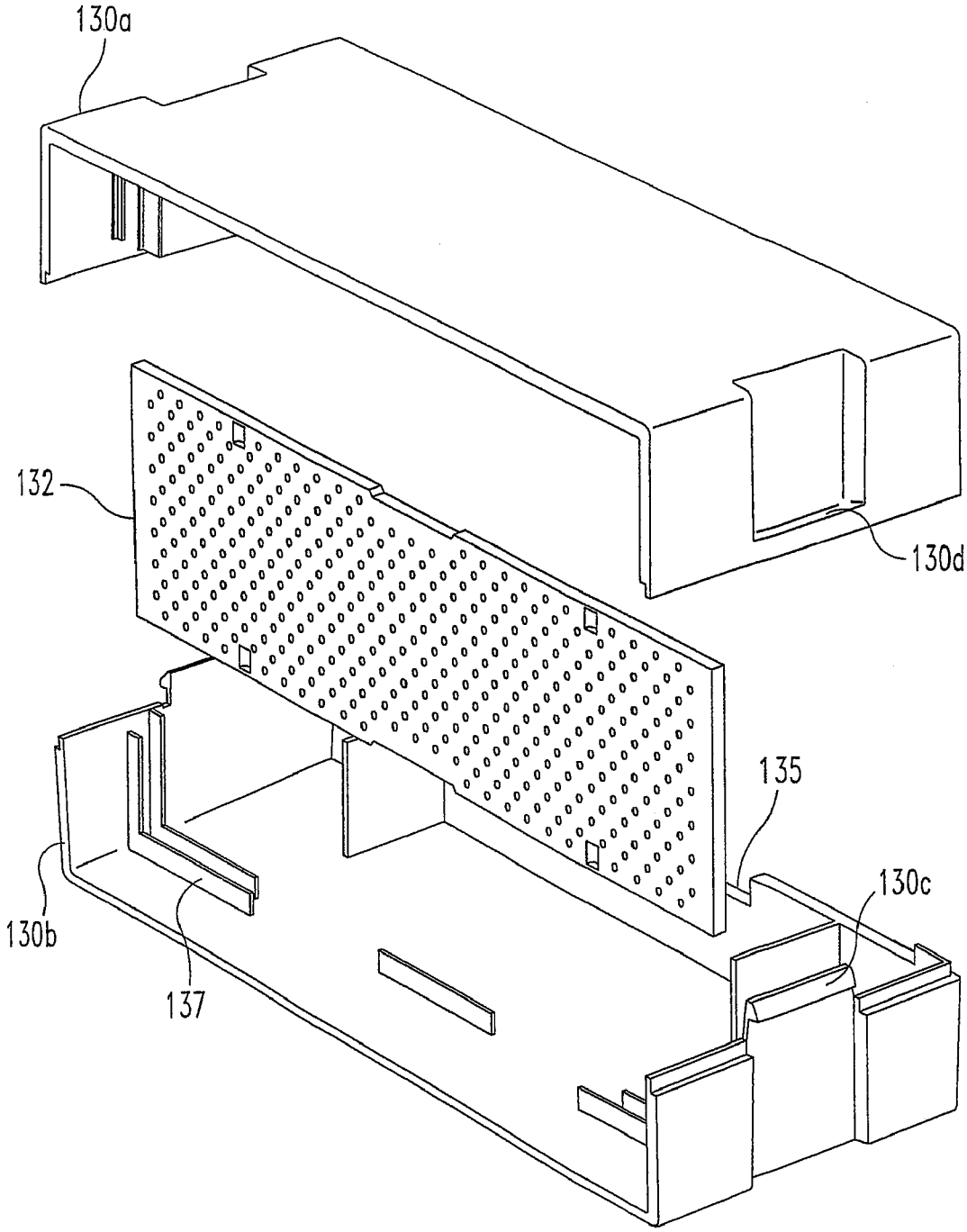
FIG. 10 is a front, top, right side exploded perspective view of a portion of the apparatus of FIG. 7.

As best seen in FIG. 10, enclosure 130 in one embodiment comprises a top half 130*a*, a bottom half 130*b*, and a porous barrier 132 located therebetween. Porous barrier 132 is held in place by aligning pairs of stiffening ridges 137, and acts as a barrier to insects and rodents. Preferably, the porosity of barrier 132 is selected such that the barrier does not appreciably impede the free flow of air through the barrier as driven by the processes of natural convection and diffusion. In one embodiment, each of the plurality of holes in barrier 132 are about 0.06 inches in diameter. Additional internal stiffening ridges 137 can be seen in FIG. 9.

In one embodiment, top half 130*a* and bottom half 130*b* are injection molded plastic, and have a wall thickness of about 0.08 to about 0.1 inches. Enclosure halves 130*a* and 130*b* are aligned together by mating peripheral ridges which extend along two opposing sides. Also, each side of enclosure 130 includes snap-together, complementary male and female couplings 130*c* and 130*d*. Preferably, enclosure 130 is fabricated to have a color that is generally the same as the color of the surrounding bricks.

Assembly of top and bottom halves 130*a* and 130*b* create an aperture 135 in the rear face of first enclosure 130. Aperture 135 is adapted and configured to slidingly and loosely receive a second enclosure 145 that is preferably part of venting and shielding member 140. Preferably, second enclosure 145 has a width that is less than the width 22 of first enclosure 130. In yet other embodiments, aperture 135 has a first shape, and the slidingly received portion of second enclosure 145 has about the same shape, but with dimensions that are smaller to ensure the sliding and generally loose fit. However, any resulting gap between aperture 135 and second enclosure 145 is made small enough to block the entrance of trash mortar into first enclosure 130.

Figure 8:
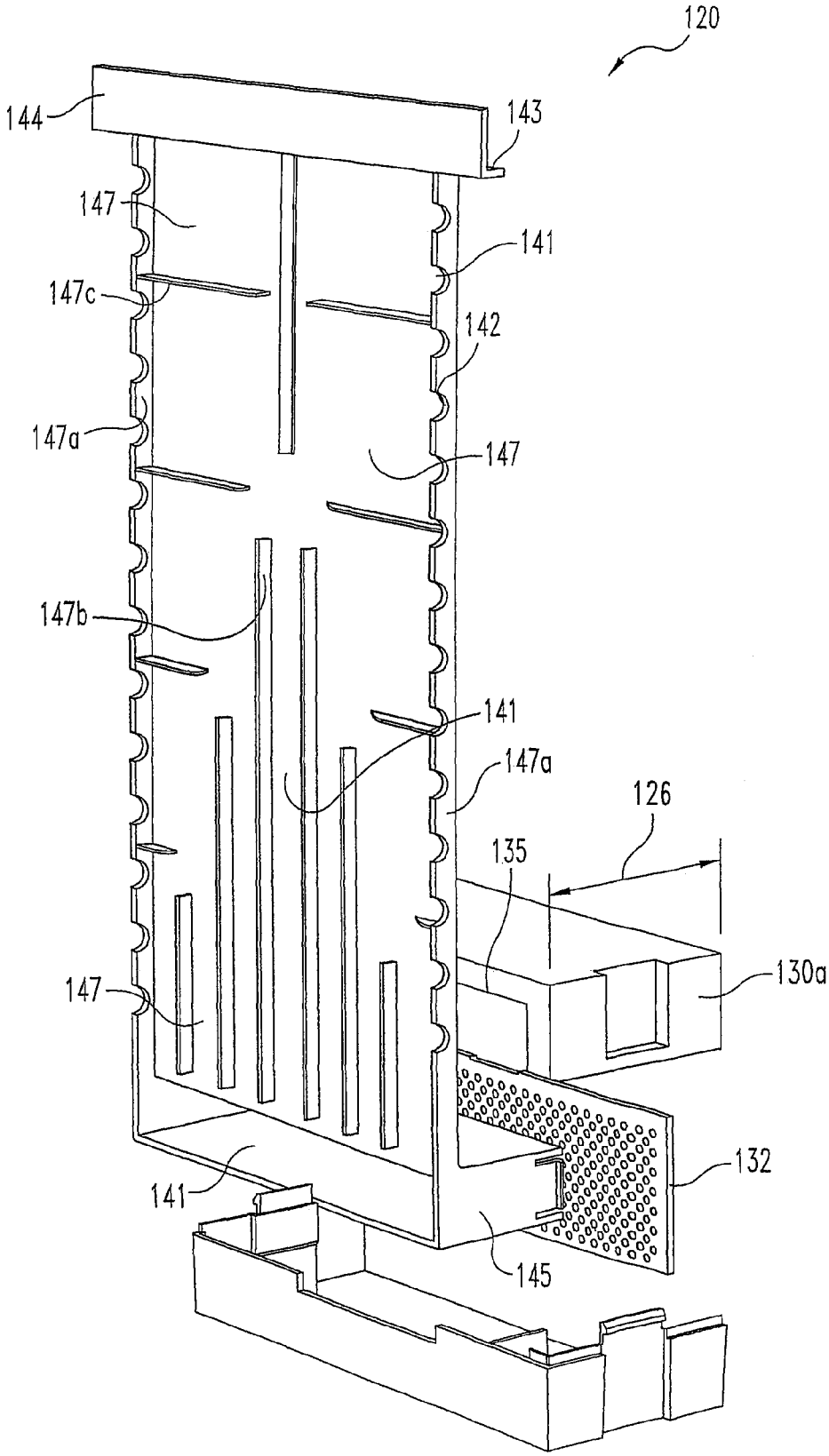
FIG. 8 is a top, rear, left side exploded perspective view of the apparatus of FIG. 7.

As best seen in FIGS. 8 and 9, venting and shielding member 140 includes a substantially vertical protected channels 147 which are in fluid communication with enclosure 145. The laterally outward-most sides of channel 147*a* include a plurality of vent openings 142, which in one embodiment of the present invention are scalloped, semi-circular openings. A plurality of vertical ribs 147*b* and horizontal ribs 147*c* extend outwardly from a face of shielding member 140. The combination of sides 147*a*, ridges 147 *b* and *c*, and the face of shielding member 140 combine to form the various protected channels 147 which establish a portion of flowpath 141 which extends along the vertical length of shielding member 140. Flowpath 141 also extends into second enclosure 145, as best seen in FIG. 8.

Second enclosure 145 includes a pair of deflectable ears 146 which are pushed inward when enclosure 145 is slid into aperture 135, and which thereafter snap out into place to act as mechanical stops which obstruct the sliding separation of the joined shielding member 140 and first enclosure 130. As best seen in FIG. 9, after engagement, second enclosure 145 can be slid away from first enclosure 130 by the sliding length 148, which is preferably a length greater than one inch. More preferably, second enclosure 145 can be slid from first enclosure 130 by a distance from 0 inches (touching) to about 1.6 inches (full extension). However, the present invention is not constrained to any of the specific dimensions provided herein. The adjustable engagement of enclosure 145 within enclosure 130 preferably permits vent assembly 120 to be installed in exterior walls that are different distances from the interior wall.

One end of shielding member 140 includes a fastener strip 144 through which fasteners can be inserted for attachment of vent assembly 120 to an interior wall. Fastener strip 144 further includes a shelf 143 adapted and configured to minimize any obstruction of apertures 142 from falling debris mortar.

Figure 11:
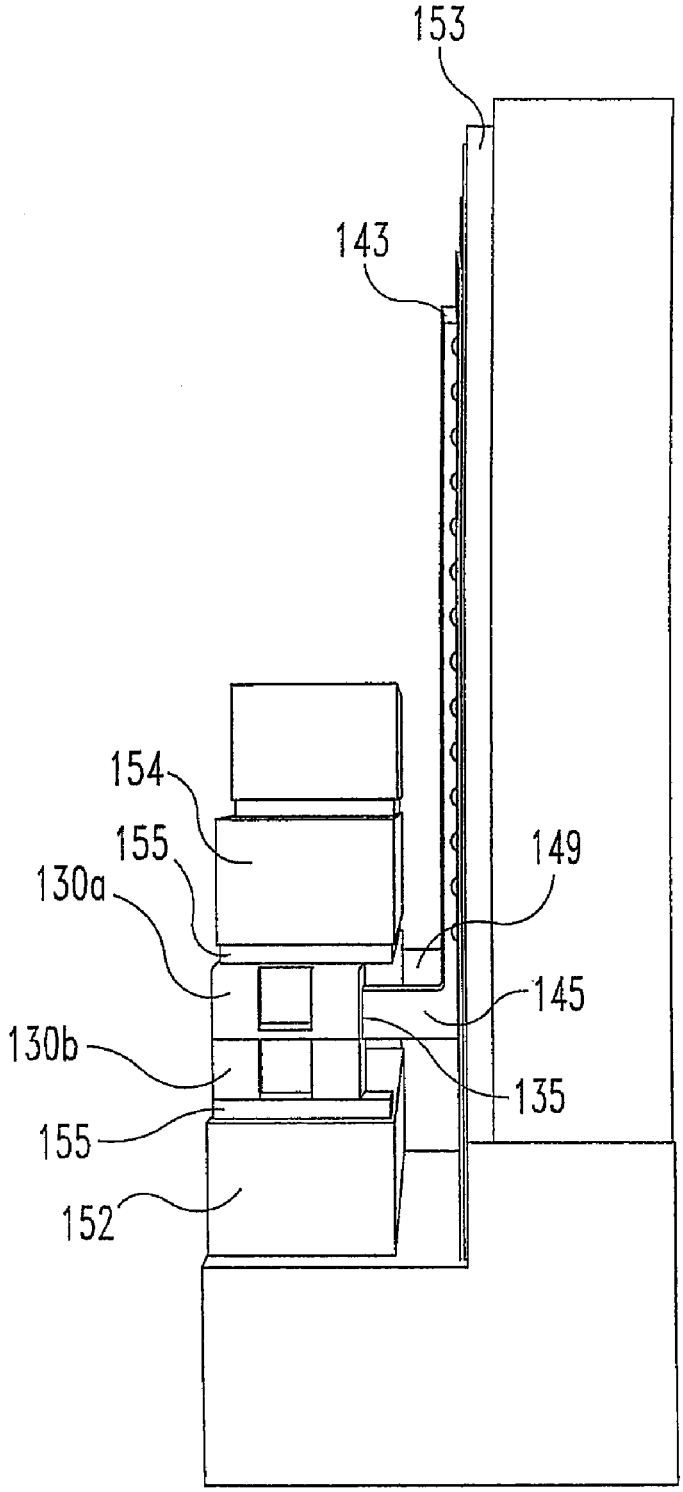
FIG. 11 is a side view of the apparatus of FIG. 7 installed in a partially built wall.
Figure 12:
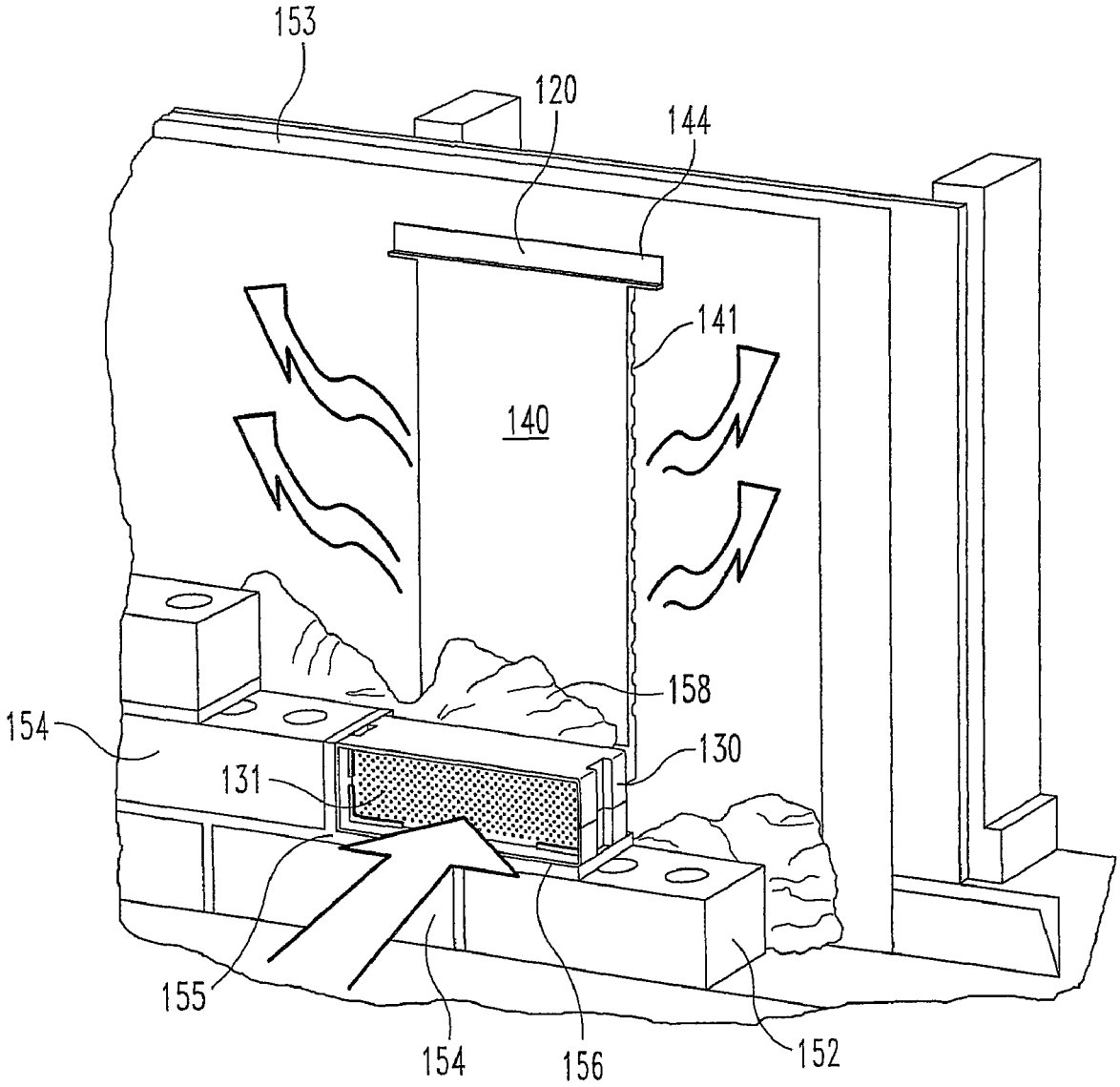
FIG. 12 is a front perspective view of the apparatus of FIG. 7 installed in a partially built wall.

FIGS. 11 and 12 show a wall vent assembly 120 according to another embodiment of the present invention as installed in a brick wall. FIGS. 11 and 12 show an exterior brick wall 152 being constructed in front of an interior wall 153. A plurality of bricks 154 are adhered together by mortar to form brick wall 152. A vent assembly 120 is shown installed over a pair of bricks 154 and adjacent to another brick 154. Vent assembly 120 is held in place in brick wall 152 by mortar 155. In some embodiments of the present invention, a plurality of vent assemblies are installed in an exterior brick wall, each vent being 5 to 6 feet from the adjacent vent.

As commonly happens during the construction of a brick wall, excess mortar applied to hold in place higher level bricks falls downward between the interior of brick wall 152 and the outermost surface of inner wall 153, as best seen in FIG. 12. This debris mortar 158 does not appreciably block the free flow of ambient air through flowpaths 131 and 141 through vent assembly 120. Referring to FIG. 12, debris mortar 158 has fallen on top shelf 149 of enclosure 145. However, shelf 149 and enclosure 145 are adapted and configured such that this debris mortar 158 does not appreciably impede the free flow of air, such as by natural convection, through flowpath 141 of enclosure 145. Further, shelf 143 along fastener strip 144 further protects flowpath 141 within the protected channels 147.

In one embodiment, the height 128 of channels 147 from shelf 149 to shelf 143 is about 13 inches. Referring to FIG. 11, although some embodiments of the present invention are shown to have a vertical portion of shielding member 140 that extends for a distance of more than about one brick height, the present invention is no so constrained, and also includes those embodiment in which a second enclosure does not include a vertical portion of appreciable length, and which is fastened to the interior wall at a position close to the second enclosure.

Further, although some embodiments of the present invention are shown with a vertical portion of shielding member 140 that extends in the upward vertical direction, the present invention is not so constrained and also includes those embodiments in which the vertical portion extends in the downward vertical direction from second enclosure 145. In such embodiments, the side of enclosure 145 opposite to shelf 149 acts as the shelf which prevents falling debris mortar from impeding the free flow of air through flow path 141 of enclosure 145.

Yet other embodiments of the present invention brick portion use only the brick portion or enclosure 130 for repair of water-damaged structures during the processes of repair and remediation. In such cases a brick and the surrounding mortar is removed from the damaged wall and a brick portion or first enclosure 130 is mortared into the wall. However, the present invention also contemplates those embodiments in which additional bricks are removed to facilitate installation of the assembly of brick portion 130 and venting and shielding assembly 140.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A wall vent for mounting to a construction having an outer wall and an inner wall that are spaced apart forming a moisture collecting area therebetween with said wall vent venting the moisture collecting area comprising:

a vent assembly mountable in a construction having an outer wall and an inner wall that are spaced apart forming a moisture collecting area therebetween, said vent assembly having a generally L shaped configuration, said vent assembly further having a horizontally extending channel including a top wall, side walls, and bottom wall joined together forming a horizontally extending passage through which moisture may move from said moisture collecting area, said vent assembly further having a vertically extending wall connected to and extending upwardly from said top wall of said horizontally extending channel into said moisture collecting area forming a vertically extending passage between said vertically extending wall and said inner wall leading to said horizontally extending passage whereby moisture may flow from said moisture collecting area through said vertically extending passage and into said horizontally extending passage to exterior of said outer wall, said vertically extending wall having a closed top wall portion preventing falling trash mortar between said outer wall and said inner wall from entering said vertically extending passage, said horizontally extending channel and said vertically extending wall are together prior to insertion into said construction; and, a water collection bin mountable in said outer wall, said bin includes a bottom water receiving receptacle and a trash mortar shielding member mounted to said receptacle limiting trash mortar from entering said receptacle, said horizontally extending channel slidingly mounted to said bin to allow said vertically extending wall to be positioned within said moisture collecting area while spaced apart from said rear wall forming said vertically extending passage depending on spacing between said inner wall and said outer wall, said water collection bin has a open front side through which moisture may move from said bin, said vertically extending passage, and said horizontally extending passage to exterior of said outer wall; and said vertically extending wall has vertically extending opposite sides with a plurality of side vents formed therein allowing moisture to flow from said moisture collecting area into said vertically extending passage, said vertically extending wall is contactable with said inner wall of said construction both at said closed top wall portion and along said vertically extending opposite sides limiting passage of trash mortar into said vertically extending passage.

2. The wall vent of claim 1 wherein:

said bin includes a rear wall with an opening, said horizontally extending channel is slidably mounted to said bin and projects through said opening into said bin, said horizontally extending channel includes movable ears thereon engagable with said bin to limit relative movement between said bin and said horizontally extending channel.

3. The wall vent of claim 2 wherein:

said vertically extending wall includes a plurality of vertically extending ribs dividing said vertically extending passage into vertically extending sub-passages.

4. The wall vent of claim 3 wherein:

said bin includes a bin top wall and a bin bottom wall with said horizontally extending channel slidable therebetween.

* * * * *